US005619918A

United States Patent [19]

Negishi et al.

[11] Patent Number: 5,619,918

[45] Date of Patent: Apr. 15, 1997

[54] STENCIL PRINTING DRUM STRUCTURE

[75] Inventors: Hideo Negishi; Toshimitsu Sakai; Yasuhiro Takahashi, all of Ibaraki, Japan

[73] Assignee: Riso Kagaku Corporation, Tokyo, Japan

[21] Appl. No.: 627,092

[22] Filed: Apr. 3, 1996

[30] Foreign Application Priority Data

Apr. 3, 1995 [JP] Japan ..... 7-077772
Jul. 28, 1995 [JP] Japan ..... 7-193372

[51] Int. Cl.[6] ..... B41L 13/00

[52] U.S. Cl. ..... 101/120; 101/116

[58] Field of Search ..... 101/116, 118, 101/119, 120, 129

[56] References Cited

U.S. PATENT DOCUMENTS 3,965,816 6/1976 Miller ..... 101/116
5,285,724 2/1994 Kobayasi et al. ..... 101/120

OTHER PUBLICATIONS

Patent Abstracts of Japan, vol. 008, No. 224 (M-331) Oct. 13, 1984 & JP-A-59-104988 Jun. 18, 1984.

*Primary Examiner*—Ren Yan
*Attorney, Agent, or Firm*—Sughrue, Mion, Zinn, Macpeak & Seas

[57] ABSTRACT

Strap-like step portions each having a smaller external diameter than the external diameter of an ink supply roller are provided at opposite ends of the ink supply roller provided in a drum. Guide surfaces of ink dams urged by springs are brought into contact with the strap-like step portions respectively. Inclined surfaces of the ink dams are brought into contact with the strap-like step portions and side end surfaces of the strap-like step portions respectively. Ink leaked onto the strap-like step portions is led to the inclined surfaces in conjunction with the rotation of the ink supply roller and returned to the inner side of the ink supply roller. Ink is prevented from being leaked out of the ink supply range of the ink supply roller, so that a printing apparatus and sheets of printing paper are not stained with ink. The state of contact between the ink dams and the ink supply roller is kept stable. If the elastic force of the springs is changed, the state of contact can be changed.

9 Claims, 10 Drawing Sheets

STENCIL PRINTING DRUM STRUCTURE

BACKGROUND OF THE INVENTION

The present invention relates to a stencil printing apparatus and particularly to a stencil printing drum.

A conventional stencil printing drum structure includes a cylindrical drum having an ink-permeable region, an ink supply roller arranged in the drum so as to be in contact with the inner surface of the drum, and an ink application roller for supplying ink to the ink supply roller. The ink supply roller is arranged so as to rotate around an axis parallel to the center axis of the drum and come into contact with the inner circumferential surface of the drum. The ink application roller is disposed in parallel to the ink supply roller to form an ink reservoir portion between the ink application roller and the ink supply roller so as to apply ink onto the surface of the ink supply roller as the ink supply roller rotates.

Of the ink supplied to the inner circumferential surface of the drum by the ink supply roller, ink leaked out of the opposite ends of the ink supply roller moves onto the inner circumferential surface of the drum. A spatula-shaped plate member is disposed in the inside of the drum so as to touch the inner circumferential surface of the drum, so that the aforementioned leaked-out ink is returned to the ink application surface corresponding to the ink supply roller in the inner circumferential surface of the drum by the plate member.

It is, however, difficult to set the pressure and angle of contact between the spatula-shaped plate member and the inner circumferential surface of the drum. It is difficult that all the leaked-out ink is returned to the ink application surface in the inner circumferential surface of the drum securely. There arises a problem that part of the leaked-out ink not caught by the spatula-shaped plate member is further leaked out of the printing drum to thereby stain a printing apparatus and sheets of printing paper with ink. There arises another problem that the spatula-shaped plate member is worn out because it always touches the inner circumferential surface of the rotating drum.

SUMMARY OF THE INVENTION

According to first aspect of the invention, there is provided a stencil printing drum structure comprising: a drum including a cylindrical wall portion having an ink-permeable region; an ink supply roller provided in parallel to the drum, the ink supply roller being rotating around an axis parallel to the center axis of the drum and in contact with the inner circumferential surface of the drum; an ink application roller provided in parallel to the ink supply roller to form an ink reservoir portion between the ink application roller and the ink supply roller, for applying ink onto a surface of the ink supply roller in accordance with rotating the ink supply roller; a pair of strap-like step portions including cylindrical surfaces extending from opposite ends of the ink supply roller respectively along the whole circumference of the ink supply roller, each of the cylindrical surface having an external diameter smaller than the external diameter of the ink supply roller; a pair of ink dams each of which has a first inclined surface slidably touching the cylindrical surface of corresponding one of the strap-like step portions for leading ink leaking onto the strap-like step portion into the ink reservoir portion; and pressing means having elastic force for urging the ink dams against the cylindrical surfaces of the strap-like step portions respectively.

According to a second aspect of the invention, there is provided the stencil printing drum structure according of the first aspect, further comprising changing means for varying the elastic force of the pressing means.

According to a third aspect of the invention, there is provided the stencil printing drum structure of the second aspect, wherein: the cylindrical wall portion of the drum is flexible; the drum structure further comprises a driving mechanism for rotating the ink supply roller in synchronism with the rotation of the drum; and the driving mechanism includes, a first gear rotating around an axis parallel to the center axis of the drum in synchronism with the drum, a first arm member swingable around an axis coincident with the axis of the first gear, the first arm member including a free end, a second gear rotatably supported on the free end of the first arm member to rotate in accordance with the first gear rotates, a second arm member swingable around a axis parallel to the axis of the first arm member, the second arm member having a free end, and a third gear rotatably supported on the free end of the second arm member and meshed with the second gear, the third gear being rotated along with the ink supply roller in accordance with the second gear.

According to a fourth aspect, there is provided the stencil printing drum structure of the first aspect, wherein each of the ink dams includes a second inclined surface adjacent to the first inclined surface with respect to the direction of rotation of the ink supply roller and slidably touching the cylindrical surface of the strap-like step portion for scrapping ink deposited on the strap-like step portion by the rotation of the ink supply roller and leading the ink thus scrapped onto the ink supply roller.

According to a fifth aspect, there is provided the stencil printing drum structure of the fourth aspect, wherein an angle between the second inclined surface and the cylindrical surface of the strap-like step portion is set to be larger than an angle between the first inclined surface and the cylindrical surface of the strap-like step portion.

Ink leaked out onto the strap-like step portions at the opposite ends of the ink supply roller is led to the ink reservoir portion in the inner side of the ink dams through the inclined surfaces of the ink dams as the ink supply roller rotates.

The state of contact between the cylindrical surfaces of the strap-like step portions and the ink dams can be adjusted suitably if the elastic force of the pressing means is changed by the changing means. Accordingly, the state of contact between the strap-like step portions of the ink supply roller and the ink dams can be kept optimum regardless of error in machining the ink dams and error in mounting the ink dams to the ink supply roller.

In the configuration in which the ink supply roller driven by the driving mechanism presses the flexible peripheral wall portion outward while rotating, the force pressing the peripheral wall portion increases as the rotation resistance of the ink supply roller increases. The force pressing the peripheral wall portion decreases as the rotation resistance decreases. Because the rotation resistance of the ink supply roller can be changed freely if the elastic force of the pressing means is changed by the changing means to adjust the state of contact between the strap-like step portions of the ink supply roller and the ink dams, the force of the ink supply roller pressing the peripheral wall portion can be adjusted correspondingly to the change of printing conditions such as kind of medium to be printed, kind of ink, printing environment temperature, etc.

Ink leaking onto the strap-like step portions at opposite ends of the ink supply roller is led into the ink reservoir portion in the inner side of the ink dams through the first inclined surfaces of the ink dams as the ink supply roller rotates. Ink not scraped by the first inclined surface is scraped by the second inclined surface. The thus scraped ink slowly moves inward while climbing the second inclined surface, so that the ink is returned, in due time, onto the ink supply circumferential surface located in front of the ink reservoir portion with respect to the direction of rotation of the ink supply roller. Then, the ink is once absorbed into the ink reservoir portion before the ink is recycled for printing.

DETAILED DESCRIPTION OF THE PREFERRED EMBODIMENTS

An embodiment of the present invention will be described below with reference to FIGS. 1 through 5.

Figure 1:
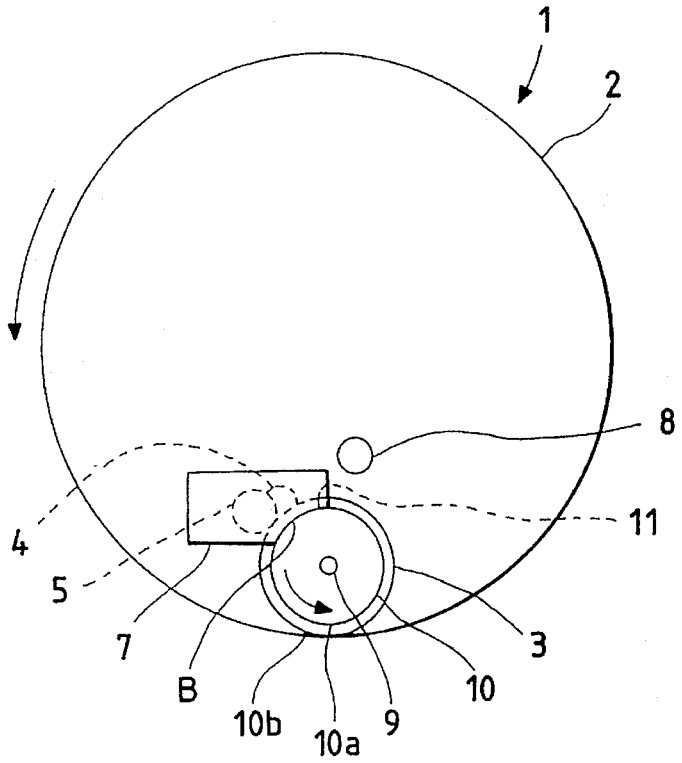
FIG. 1 is a side view typically showing a stencil printing drum structure according to the present invention.
Figure 2:
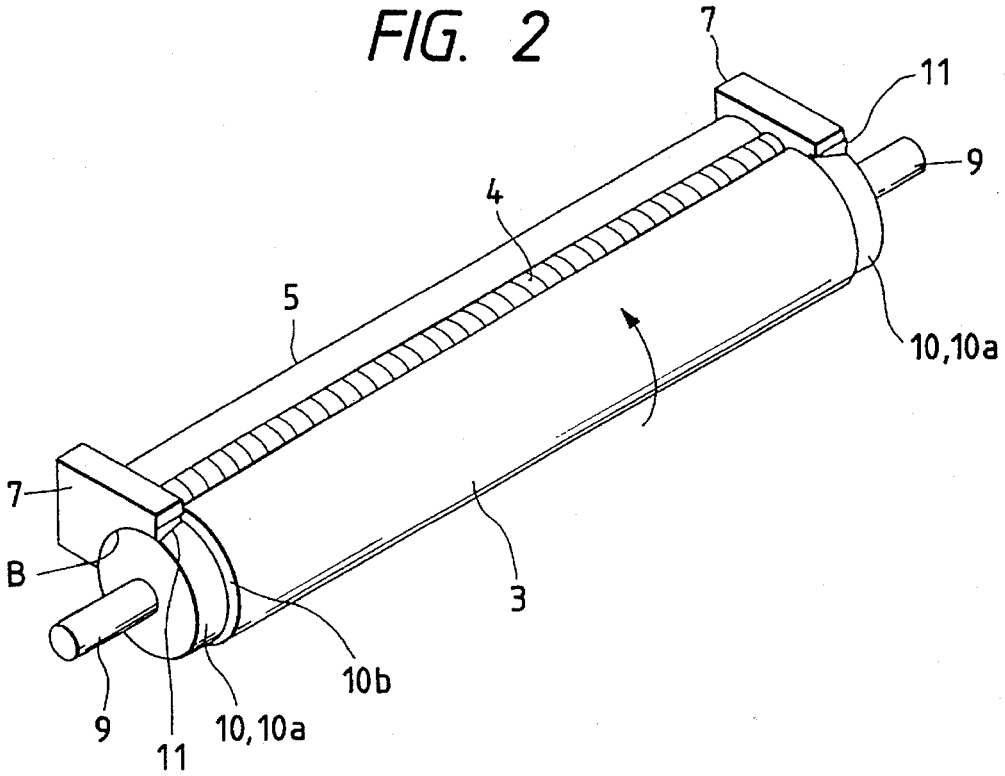
FIG. 2 is a perspective view for explaining the behavior of ink in the stencil printing drum structure of the invention.

A stencil printing drum structure 1 shown in FIG. 1 has a cylindrical drum 2 having an ink-permeable region. An ink supply roller 3 is provided in the inside of the drum 2. The ink supply roller 3 is arranged so as to be rotatable around a rotary shaft 9 parallel to the center axis of the drum 2 and to be able to contact with the inner circumferential surface of the drum 2. The printing drum structure 1 is designed so as to rotate counterclockwise in FIG. 1. The drum 2 is constituted by a porous plate or screen having a large number of fine pores formed therein. Though not shown, a sheet of stencil paper is wound on the surface of the drum 2 and an end of the paper is locked by a locking device.

An ink application roller 5 is provided in the inside of the drum 2. The ink application roller 5 is disposed in parallel to the ink supply roller 3 and in a portion adjacent to the lag side of the direction of rotation of the ink supply roller 3 rotating counterclockwise, and the ink application roller 5 is designed so as to apply ink 4 in an ink reservoir portion onto the ink supply roller 3.

The reference numeral 8 designates an ink distributer by which ink supplied by an ink supply means (not shown) is supplied between the ink supply roller 3 and the ink application roller 5. When supplied, the ink is led into the ink reservoir portion formed between the two rollers 3 and 5.

Strap-like step portions 10 each of which has a width A and an external diameter smaller than the external diameter of the ink supply roller 3 and are formed at the axially opposite ends of the ink supply roller 3 along the whole circumference of the roller 3. Further, a pair of ink dams 7 are provided at the axially opposite ends of the ink supply roller 3 so that the ink reservoir portion is formed between the pair of ink dams 7.

Each of the ink dams 7 is a substantially rectangular-parallelepiped member having a concavely curved guide surface B on its one corner so that the guide surface B is in contact with a cylindrical surface 10a of each of the strap-like step portions 10 so as to hang over the cylindrical surface 10*a*. Further, a part C of the inner side surface of each of the ink dams 7 is disposed so as to contact with a side end surface 10*b* of the strap-like step portion 10.

Figure 3:
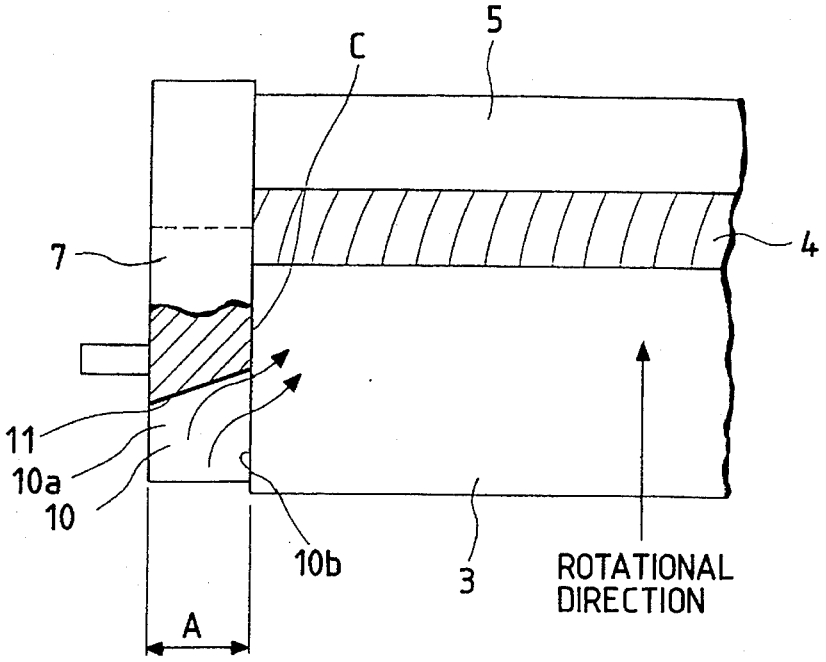
FIG. 3 is a plan view showing the strap-like step portion in FIG. 2.

An inclined surface 11 is provided in an upper end portion of the guide surface B of each of the ink dam 7 so that ink leaked out onto the strap-like step portion 10 is led into the ink reservoir portion. As shown in FIG. 3, the inclined surface 11 is formed at an angle of inclination which is such that the depth of a portion near the inside of the ink supply roller 3 is larger than the depth of a portion near the end portion of the ink supply roller 3 from the direction of rotation of the ink supply roller represented by the linear arrow shown in FIG. 3, that is, the inclined surface 11 is formed so as to extend upward of the outer circumferential surface of the ink supply roller 3.

Accordingly, ink leaked onto the strap-like step portion 10 is received by the inclined surface 11 of the ink dam 7 as the ink supply roller 3 rotates, and led by the inclined surface 11 so as to go back to the inner side of the ink supply roller 3.

Figure 4:
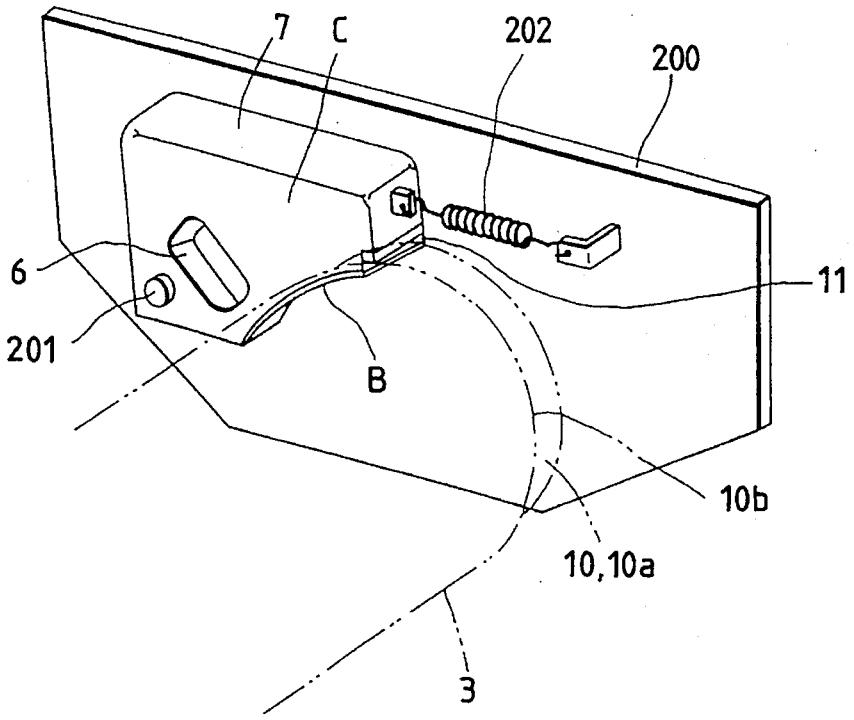
FIG. 4 is a perspective view showing the ink dam in the invention.

As shown in FIG. 4, one end portion of the ink dam 7 is attached to a frame 200 of this apparatus so as to be rotatable around a shaft 201. The other end portion of the ink dam 7 is connected to the frame 200 through a spring 202 acting as a pressing means. The ink dam 7 pulled by the spring 202 rotates around the shaft 201 so as to come near the ink supply roller 3, so that the guide surface B thereof is brought into contact with the cylindrical surface 10a of the strap-like step portion 10 of the ink supply roller 3 by a predetermined amount of pressure. The guide surface B is constituted by a member, such as a brake shoe, separate from the body of the ink dam 7, taking into account abrasion resistance and frictional resistance. That is, the guide surface B is removable so that it can be exchanged when worn out.

A long groove 6 is formed in the inside of each the ink dam 7 so that opposite end portions of the ink application roller 5 are movably supported to thereby make it possible to adjust the gap between the ink supply roller 3 and the ink application roller 5. The distance between the ink application roller 5 and the ink supply roller 3 can be set to a desired state by moving/adjusting the mount position of the ink application roller 5 with respect to the ink dam 7 along the groove 6.

In FIG. 1, when the drum 2 rotates counterclockwise, the ink supply roller 3 rotates counterclockwise around the rotary shaft 9. Ink supplied by an ordinary supply means not shown is supplied through an ink distributer 8 to the neighborhood of the contact portion between the ink application roller 5 and the ink supply roller 3 to form an ink reservoir portion. A bar-like ink whirlpool is formed in the ink reservoir portion as the printing operation is carried out, so that ink 4 is applied from the ink whirlpool onto the ink supply roller 3 by the ink application roller 5. The ink 4 applied onto the ink supply roller 3 is supplied to the inner circumferential surface of the drum 2.

The ink 4 which forms the ink reservoir portion is prevented from spreading laterally out of the side wall of each the ink dam 7. The guide surface B of the ink dam 7 is in contact with the cylindrical surface 10*a* of the strap-like step portion 10, and ink leaked onto the strap-like step portion 10 of the ink supply roller 3 is returned to the reservoir portion of the ink 4 by the inclined surface 11 of the ink dam 7 which is in contact with the side end surface 10*b* of the strap-like step portion 10. Hence, the ink 4 is limited securely so that the ink 4 is not leaked out of the ink supply range of the ink supply roller 3. Accordingly, there arises no problem that the printing apparatus and the printing sheet are stained with ink.

Further, the ink dam 7 is urged against the strap-like step portion 10 of the ink supply roller 3 by elastic force of the spring 202 while kept rotatable around the shaft 201 so as to move far from the ink supply roller 3 when the ink dam 7 receives some load from the ink supply roller 3 rotating in a period of printing. Accordingly, not only the contact state between the ink dam 7 and the ink supply roller 3 is kept stable but also the contact state between the ink dam 7 and the strap-like step portion 10 of the ink supply roller 3 is set/kept good regardless of error in machining the ink dam 7 and error in mounting the ink dam 7 to the ink supply roller 3.

Figure 5:
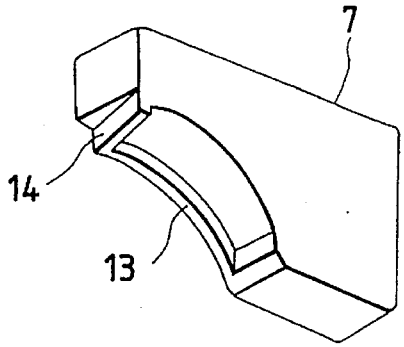
FIG. 5 is a perspective view showing another shape of the ink dam in the invention.

FIG. 5 is a perspective view showing another embodiment of the shape of the ink dam. In the ink dam 7 described above, the guide surface B in contact with the strap-like step portion 10 of the ink supply roller 3 is a simple-curved surface. In the ink dam 7 shown in FIG. 5, the portion in contact with the strap-like step portion 10 of the ink supply roller 3 is formed as a narrow guide projection 13 fitted to the outer circumferential surface of the strap-like step portion 10. Because the contact area between the guide projection 13 and the strap-like step portion 10 is smaller than the contact area between the guide surface B described above and the strap-like step portion 10 so that friction is reduced, the guide projection 13 of the ink dam 7 can be strongly pressed against the cylindrical surface 10*a* of the strap-like step portion 10 to improve a sealing effect without making the load on the ink supply roller 3 greater unnecessarily. In FIG. 5, the reference numeral 14 designates an inclined surface which has the same function as that of the foregoing inclined surface 11 and which is formed so as to be continued to the guide projection 13.

In the stencil printing drum structure of the above embodiment, the strap-like step portions 10 each of which has an external diameter smaller than the external diameter of the ink supply roller 3 are provided at the opposite ends of the ink supply roller 3 and the rotatably pivoted ink dams 7 are brought, by elastic force of springs 202, into contact with the strap-like step portions 10. The ink leaking out onto the strap-like step portions 10 is returned to the inner side of the ink supply roller 3 by means of the inclined surfaces 11 provided in the ink dams 7 respectively. Accordingly, in this embodiment, there arises no problem that the printing apparatus and the printing sheet are stained with ink, because the contact state between the strap-like step portion 10 of the ink supply roller 3 and the ink dam 7 is stable so that ink does not leak out of the ink supply range of the ink supply roller 3.

Figure 10:
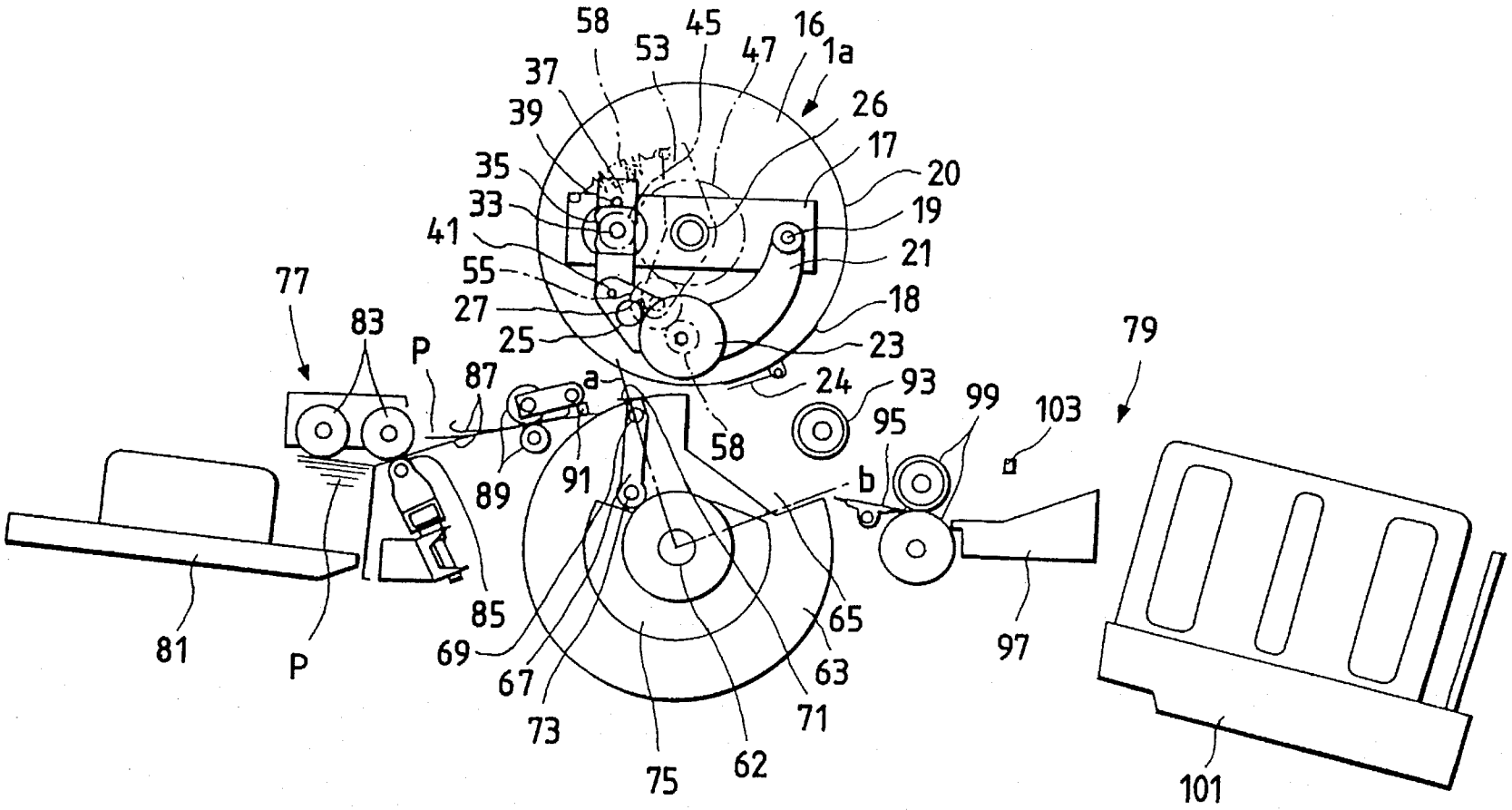
FIG. 10 is a view showing a schematic configuration of the stencil printing apparatus of the invention.
Figure 11:
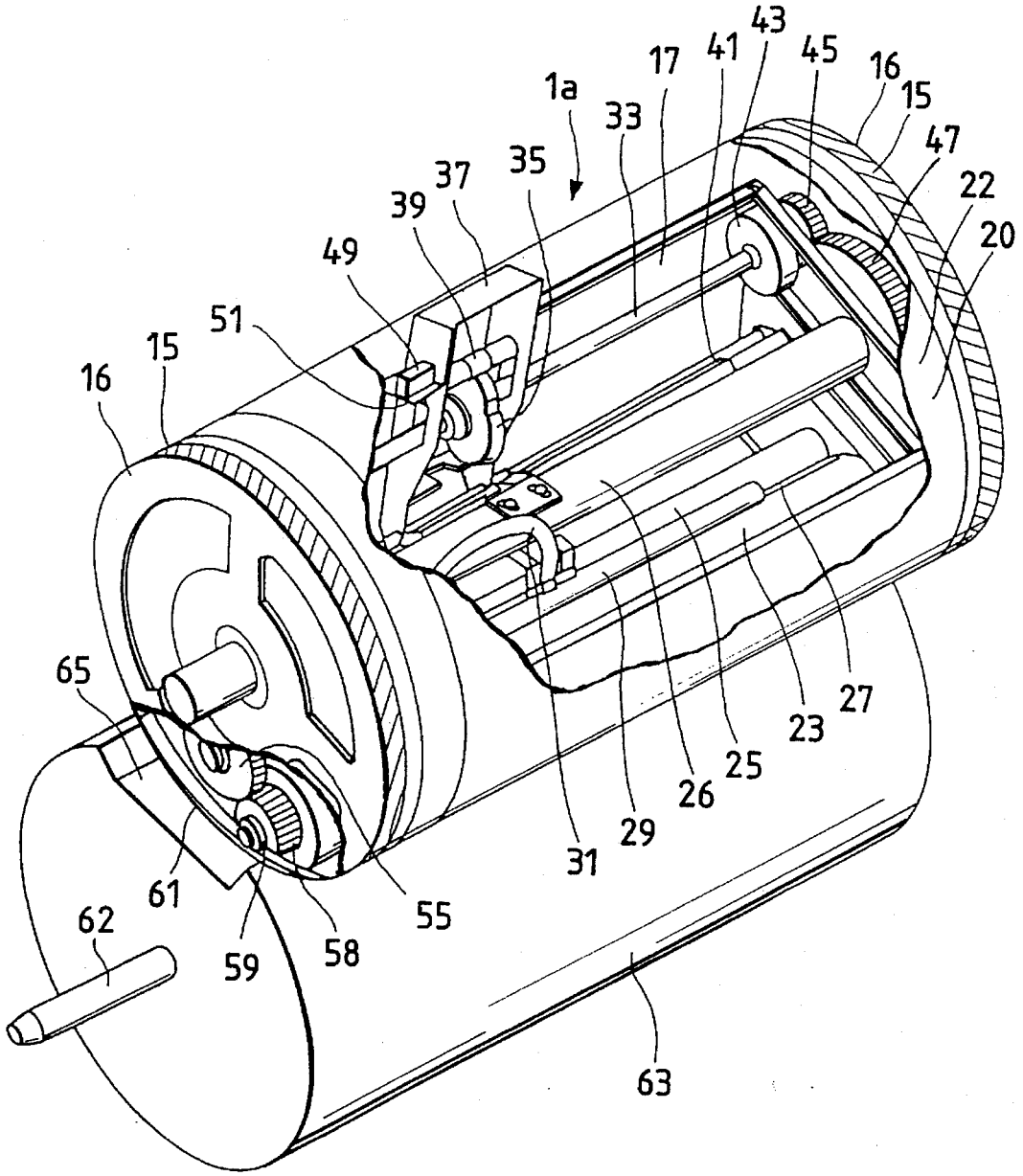
FIG. 11 is a partly cutaway perspective view showing the stencil printing drum structure of the invention.

FIGS. 10 and 11 show the overall configuration of a stencil printing apparatus to which the stencil printing drum structure described in the above embodiment can be applied. In FIGS. 10 and 11, the configuration of the ink dams 7, the springs 202 for pressing the ink dams 7 against the ink supply roller 3, or the like, is not shown but the feature of other parts will be described with reference to FIGS. 10 and 11. In FIGS. 10 and 11, the reference numeral la designates a cylindrical drum which is shown wholly as a stencil printing drum structure. The cylindrical drum 1*a* has a pair of disk-like rigid-body structure side plates 16 arranged parallel at a predetermined distance, a rigid-body structure clamp base strap 18 extending in the direction of the axis (the direction of the generatrix) of the cylinder and for connecting the pair of side plates 16 to each other, and a screen member 22 having opposite side edge portions supported by the pair of side plates 16 to form an ink-permeable structure flexible peripheral wall portion 20 stretched cylindrically. The screen member 22 is constituted by a flexible woven net made of a wire material such as stainless steel wire, or the like. The screen member 22 has a structure in which printing ink is allowed to pass by a mesh portion. The flexible peripheral wall portion 20 can be deformed so as to swell out radially because the screen member 22 constituting the flexible peripheral portion 20 is flexible.

A clamp plate 24 for detachably clamping one end (leading end) of a stencil sheet is mounted on the clamp base strap 18, so that the stencil sheet is wound/attached on the outer circumferential surface of the flexible peripheral wall portion 20 while it is locked on the clamp base strap 18 by the clamp portion 24.

A center cylinder shaft 26 pierces the cylindrical drum 1*a* along the center axis of the latter. The cylindrical drum 1*a* is supported so as to be rotatable around the center cylinder shaft 26. Drum driving gear portions 15 are formed in the outer circumferential portions of the two side plates 16 respectively. Drum drive motor driving gears not shown are engaged with the drum driving gear portions 15 to thereby drive the cylindrical drum 1*a* to rotate counterclockwise, in the drawing, around the center cylinder shaft 26 acting as a fixed support shaft body.

An inner-drum frame 17 is fixedly arranged in the cylindrical drum 1*a* supported by the center cylinder shaft 26. An end of a roller support arm 21 is rotatably attached to one side portion of the inner-drum frame 17 through a pivot 19, so that the roller support arm 21 can swing substantially up and down around the pivot 19. An ink supply roller 23 for squeezing ink onto the inner circumferential surface of the cylindrical drum 1*a* is rotatably supported in an intermediate portion of the roller support arm 21. The ink supply roller 23 is arranged so that the center axis of the ink supply roller 23 is parallel to the generatrix of the cylindrical drum 1*a* . The outer circumferential surface of the ink supply roller 23 slidably touches the inner circumferential surface of the flexible peripheral wall portion 20.

The roller support arm 21 fixedly supports a doctor rod 25 acting as an ink application roller which extends so as to be parallel to the outer circumferential surface of the ink supply roller 23 at a small distance. Predetermined amount of printing ink is supplied between the ink supply roller 23 and the doctor rod 25 from an ink delivery pipe 29 acting as an ink distributer to form a wedge-like ink reservoir portion 27. An ink supply hose 31 is connected to the ink delivery pipe 29. The ink supply hose 31 passes through the inside of the center cylinder shaft 26 and extends to the outside of the drum so as to be connected to an ink supply source not shown but arranged in the outside of the drum. Thus, printing ink is given.

Amount of printing ink in the ink reservoir portion 27 is measured when it is passed through a fine gap between the ink supply roller 23 and the doctor rod 25 as the ink supply roller 23 rotates counterclockwise in the drawing, and the printing ink thus measured adheres on the outer circumferential surface of the ink supply roller 23 to form a layer of a predetermined thickness, is carried to the inner circumferential surface of the flexible peripheral wall portion 20 by the counterclockwise rotation, in the drawing, of the ink supply roller 23. Then, the printing ink is squeezed onto the inner circumferential surface of the flexible peripheral wall portion 20.

The inner-drum frame 17 supports a cam shaft 33 rotatably. A cam 35 is fixed onto the cam shaft 33. The cam 35 is a double-heart-shaped plate cam, so that one stable state is selected from the two stable states of a printing rotation position and a non-printing rotation position shown in FIG. 10 by rotating the cam 35 by every 90°.

A linkage yoke member 37 is connected to the other end of the roller support arm 21 so as to be rotatable on a pivot 41. A cam follower roller 39 is attached to the linkage yoke member 37. The cam 35 is engaged with the cam follower roller 39.

When the cam 35 is located in the printing rotation position, the ink supply roller 23 descends and slidably touches the inner circumferential surface of the flexible peripheral wall portion 20 of the drum 1*a*. When the cam 35 is located in the non-printing rotation position, the ink supply roller 23 is lifted up together with the roller support arm 21, moved inward in the radial direction of the cylindrical drum 1*a* and departed from the inner circumferential surface of the flexible peripheral wall portion 20 (see FIG. 10).

As shown in FIG. 11, a cam shaft 33 is connected to the follower side of an electromagnetic clutch 43, and the drive side of the electromagnetic clutch 43 is connected to a cam shaft driving gear 45. The electromagnetic clutch 43 selectively connects the cam shaft driving gear 45 and the cam shaft 33 to drive the cam shaft 33. The cam shaft driving gear 45 engages with an inner-drum main gear 47 fixed to the side plate 16 of the drum 1*a* so as to be driven to rotate in conjunction with the rotation of the cylindrical drum 1*a*.

Figure 9:
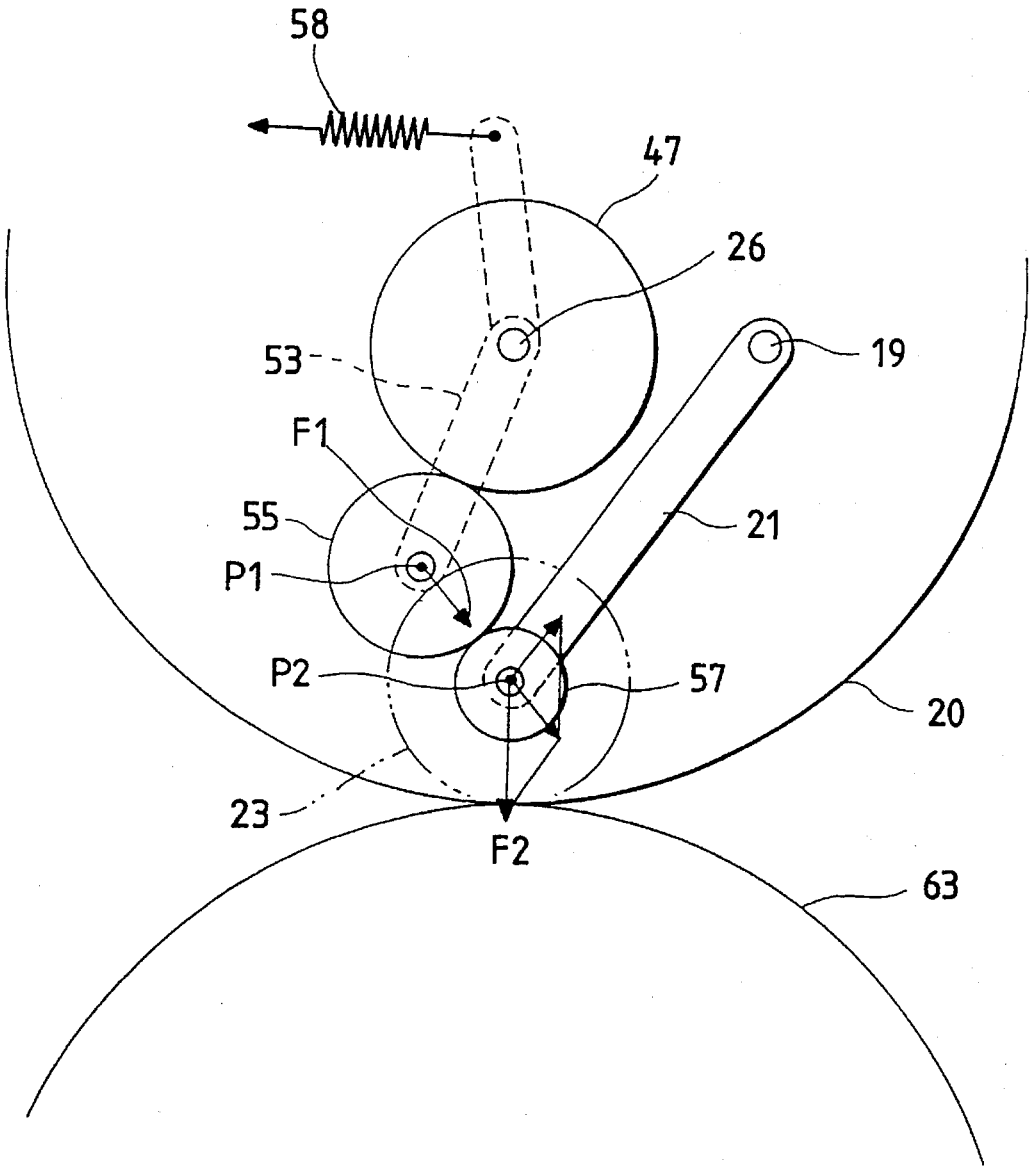
FIG. 9 is a view for explaining the mechanism by which printing pressure is generated in the stencil printing apparatus of the invention.

As shown in FIG. 9, the center cylinder shaft 26 rotatably supports the intermediate portion of a roller driving arm 53 in the drum. An intermediate gear 55 is rotatably supported to one lower end of the roller driving arm 53. The other upper end f the roller driving arm 53 is connected to the inner-drum frame 17 through a tensile spring 58, so that the roller driving arm 53 is urged to rotate counterclockwise in FIG. 10 by spring force of the tensile spring 58. A gear 57 is provided concentrically at an end portion of the ink supply roller 23. The intermediate gear 55 engages both with the gear 57 and with the inner-drum main gear 47. When the inner-drum main gear 47 rotates counterclockwise in accordance with the rotation of the cylindrical drum 1*a*the intermediate gear 55 is driven to rotate clockwise so that the gear 57 engaging with the intermediate gear 55 and the ink supply roller 23 concentric to the gear 57 rotate counterclockwise in FIG. 10. That is, the ink supply roller 23 is driven to rotate in the same direction as the cylindrical drum 1*a*.

Because the ink supply roller 23 is driven to rotate counterclockwise in FIG. 10 as described above when the cam 35 is located in the printing rotation position and the ink supply roller 23 is located in a descending position in which the ink supply roller 23 slidably touches the inner circumferential surface of the flexible peripheral wall portion 20 of the drum 1*a*, the ink supply roller 23 is brought into forced contact with the inner circumferential surface of the flexible peripheral wall portion 20 to thereby deform the flexible peripheral wall portion 20 to swell out toward a press roller 63 which will be described later.

Contrariwise, when the cam 35 is located in the non-printing rotation position and the ink supply roller 23 is departed from the inner circumferential surface of the flexible peripheral wall portion 20 of the drum 1*a*the ink supply roller 23 does not deform the flexible peripheral wall portion 20 to swell out even though the ink supply roller 23 is driven to rotate counterclockwise in FIG. 10 as described above, that is, the swelling/deformation of the flexible peripheral wall portion 20 is released. Hereinafter, this position (see FIG. 10) of the ink supply roller 23 is referred to as a standing-state position.

Further, as shown in FIG. 11, a cam follower roller 59 is attached to an end portion of the shaft of the ink supply roller 23. The cam follower roller 59 engages with a cam portion 61 formed in the inner circumferential surface of the cylindrical drum 1*a*. When the cylindrical drum 1*a* rotates, the rotating cam portion 61 follows the cam follower roller 59 so that the ink supply roller 23 ascends and descends repeatedly in predetermined timing in synchronism with the rotation of the drum 1*a*.

In a rotation phase corresponding to the region in which the sheet of stencil paper on the drum 1*a* is clamped, the ink supply roller 23 is lifted up with respect to the inner circumferential surface of the drum 1*a*. That is, in this case, the ink supply roller 23 moves radially inward to release the flexible peripheral wall portion 20 from the swell-out deformation. Hence, not only collision noise is prevented from being generated because of the collision between the clamp base strap 18 and a corner portion of a concave portion 65 of the press roller 63 which will be described later, but also the screen member 22 is protected. In other words, the forced contact of the ink supply roller 23 with the inner circumferential surface of the flexible peripheral wall portion 20 is released in order to prevent interference between the drum 1*a* and the press roller 63 at the time of non-printing.

The press roller 63 has the same external diameter as the cylindrical drum 1*a* and has a center shaft 62 so that the press roller 63 is provided at a predetermined distance from the flexible peripheral wall portion 20 and parallel to the cylindrical drum 1*a*. The press roller 63 is driven to rotate clockwise in FIG. 10 synchronously at the same speed as that of the cylindrical drum 1*a* by a synchronous rotation driver not shown but disposed in the periphery of the center axis of the press roller 63. The press roller 63 has a concave portion 65 in the outer circumferential portion of the rotation position corresponding to the clamp portion 24 of the cylindrical drum 1*a* in order to avoid the interference with the clamp portion 24.

From the relative position relation between the cylindrical drum 1*a* and the ink supply roller 23 as described above, when the flexible peripheral wall portion 20 is deformed to swell out, the swell-out deformed portion of the cylindrical drum 1*a* is brought into forced contact with the press roller 63 so that the sheet of stencil paper wound on the outer circumferential surface of the drum and a printing sheet P are put between the cylindrical drum 1*a* and the press roller 63. In a state in which the swell-out deformation of the flexible peripheral wall portion 20 is canceled, as shown in FIG. 10, a gap is formed between the cylindrical drum 1*a* and the press roller 63 to allow the printing sheet P to pass freely.

As shown in FIG. 10, a paper clamp member 67 is provided on the press roller 63. The paper clamp member 67 is attached to the press roller 63 so as to be rotatable on a pivot 69. The paper clamp member 67 has as its one end a clamp portion 71 for detachably clamping the printing sheet P in cooperation with the outer circumferential surface of the press roller 63, and has as its opposite end a cam follower roller 73. The cam follower roller 73 engages with a cam 75 which is arranged so as to be fixed to an apparatus frame not shown but for rotatably supporting the press roller 63. When the press roller 63 rotates, the movement of the cam 75 is followed by the cam follower roller 73 to drive the paper clamp member 67. That is, when a printing sheet P is supplied from a paper feeding portion 77 in the left of FIG. 10 in synchronism with the rotation of the press roller 63, the paper clamp member 67 clamps a leading end of the printing paper P in a rotation position (paper clamping position) represented by the reference character a in FIG. 10 and cancels the clamping in a rotation position (paper release position) b in the paper discharge portion 79 in the right of FIG. 10. Hence, the press roller 63 winds the printing sheet P on its outer circumferential surface between the paper clamping position a and the paper release position b and forcedly carries the printing sheet P.

The paper feeding portion 77 has a paper feeding table 81 on which sheets of printing paper are piled, paper feeding rollers 83 and a paper dealing roller 85 for picking up the sheets of printing paper P one by one from the paper feeding table 81, paper guide members 87, a pair of timing rollers 89 for feeding a printing sheet P to a paper clamping position a in predetermined timing so that the printing sheet P is clamped by the clamp portion 71 of the press roller 63, and an optical paper feeding sensor 91 for detecting the feeding of printing paper P to the paper clamping position a.

The paper discharge portion 79 has a paper discharge pinch roller 93 arranged in the paper release position b and for performing a pinch roller function in conjunction with the press roller 63 to eject the printing sheet P, a paper separating claw 95 for separating the printing sheet P from the press roller 63, a pair of paper discharge pinch rollers 99 for feeding the thus separated printing sheet P to a paper flight deck 97, a paper discharge mount 101 on which sheets of printing paper P are put after printing, and an optical paper discharge sensor 103 for detecting the flight of the printing sheet P from the paper flight deck 97 toward the paper discharge table 101.

The paper discharge pinch roller 93 and the upper roller of the pair of paper discharge pinch rollers 99 slidably touching the upper surface of the ejected printing sheet P, that is, the printing image surface, are formed so as to slidably touch only blank portions (non-printing margin portions) in opposite sides of the printing sheet P. Further, the axial positions thereof are adjusted automatically correspondingly to the size of printing paper P set on the paper feeding table 81 so that the paper discharge pinch roller 93 and the upper roller of the pair of the paper discharge pinch rollers 99 slidably touch only the blank portions in opposite sides of printing paper P regardless of the widthwise size of printing paper P. In this case, a paper size sensor not shown but for detecting the size of printing paper P is provided in the paper feeding table 81.

The operation of the stencil printing apparatus configured as described above will be described.

When a start key on an operation panel not shown is pushed after a sheet of stencil paper formed is wound on the outer circumferential surface of the cylindrical drum 1*a* attached thereto, not only the cylindrical drum 1*a* and the press roller 63 start rotation but also sheets of printing paper P are picked up one by one from the paper feeding table 81 by the paper feeding rollers 83 and the paper dealing roller 85 and guided to the pair of timing rollers 89 by the paper guide member 87.

When the cylindrical drum 1*a* and the press roller 63 rotate to predetermined rotation phase positions, the pair of timing rollers 89 feed the printing sheet P to the paper clamping position a in predetermined timing so that the printing sheet P is clamped by the clamp portion 71 of the press roller 63.

Then, current conduction in the electromagnetic clutch 43 is executed for a predetermined time. Hence, the cam 35 rotates by 90°to be located in the printing rotation position, and the ink supply roller 23 is located in the aforementioned descending position and rotates following the rotation of the cylindrical drum 1*a* to press the flexible peripheral wall portion 20 radially outward to thereby deform the flexible peripheral wall portion 20 to swell out toward the press roller 63.

In this state, the clamp portion 71 of the press roller 63 clamps the leading end of the printing sheet P in the paper clamping position a, and then the printing sheet P is wound on the outer circumferential surface of the press roller 63 by the rotation of the press roller 63 so that the printing sheet P moves toward the contact portion of the cylindrical drum 1*a*, that is, toward the swell-out deformed portion of the flexible peripheral wall portion 20. Hence, the printing sheet P is put between the cylindrical drum 1*a* and the press roller 63 with a predetermined amount of pressing force in the swell-out deformed portion so that pressure stencil printing is performed while the printing sheet P is carried by the rotation of the cylindrical drum 1*a* and the press roller 63.

When the cylindrical drum 1*a* and the press roller 63 rotate until the clamp portion 71 reaches in the paper release position b, the clamping of printing paper P by the clamp portion 71 is canceled and the printing sheet P is carried continuously by the paper discharge pinch roller 93. Thereafter, the printing sheet P is separated from the press roller 63 by the paper separating claw 95, fed to the paper flight deck 97 by the pair of paper discharge pinch rollers 99, flown from the paper flight deck 97 to the paper discharge mount 101 and put on the paper discharge mount 101 with the printing image surface up.

The aforementioned printing apparatus comprises: a cylindrical drum 1*a* having a flexible peripheral wall portion 20; an ink supply roller 23 ascending and descending in the cylindrical drum 1*a* in synchronism with the rotation of the cylindrical drum 1*a* to thereby deform the cylindrical drum 1*a* outward; and a press roller 63 arranged in the outside of the cylindrical drum 1*a*, wherein a printing sheet is put between the flexible peripheral wall portion 20 of the deformed cylindrical drum 1*a* and the press roller 63 to perform printing, force for pressing out the flexible peripheral wall portion 20 has large influence on the state of the resulting printing image. The force of the ink supply roller 23 pressing the flexible peripheral wall portion 20 radially outward to deform the flexible peripheral wall portion 20 to swell out toward the press roller 63 increases as the rotation resistance of the ink supply roller 23 increases but the force decreases as the rotation resistance decreases.

That is, in FIG. 9, when the rotation resistance of the ink supply roller 23 or the rotation resistance of the gear 57 united with the ink supply roller 23 is larger than the rotation resistance of the roller driving arm 53 with respect to the center cylinder shaft 26, the intermediate gear 55 engaged with the gear 57 tries to rotate while rolling clockwise on the outer circumference of the gear 57. Because the intermediate gear 55 is supported by the free end portion of the roller driving arm 53 so as to be allowed to move only on a circular arc with the center cylinder shaft 26 as its center, the intermediate gear 55 presses the gear 57 by the force of vector F1 of FIG. 9 on a virtual line connecting the respective rotation centers P1 and P2 of the two gears. Accordingly, the gear 57 moves toward the press roller 63 along a circular arc with the pivot 19 as its center, so that the ink supply roller 23 presses the press roller 63 by the force of vector F2 proportional to the force of vector F1.

Because the aforementioned force of vector F1 is proportional to the rotation resistance of the gear 57, the force (printing force) of the gear 57 pressing the press roller 63 through the ink supply roller 23 increases as the rotation resistance of the gear 57 increases.

In the stencil printing apparatus described above with reference to FIGS. 10 and 11, the rotation resistance of the ink supply roller 3 in contact with the ink dams 7 can be adjusted suitably by suitable adjustment of the elastic force of the springs 202 if the stencil printing drum structure of the aforementioned embodiment in which the ink dams 7 are pressed against the ink supply roller 3 by the springs 202 is applied to the apparatus. Hence, the force of the ink supply roller pressing out the peripheral wall portion can be adjusted to obtain a good printing image correspondingly to the change of printing conditions such as kind of a medium to be printed, kind of ink, printing environment temperature, etc.

Figure 6:
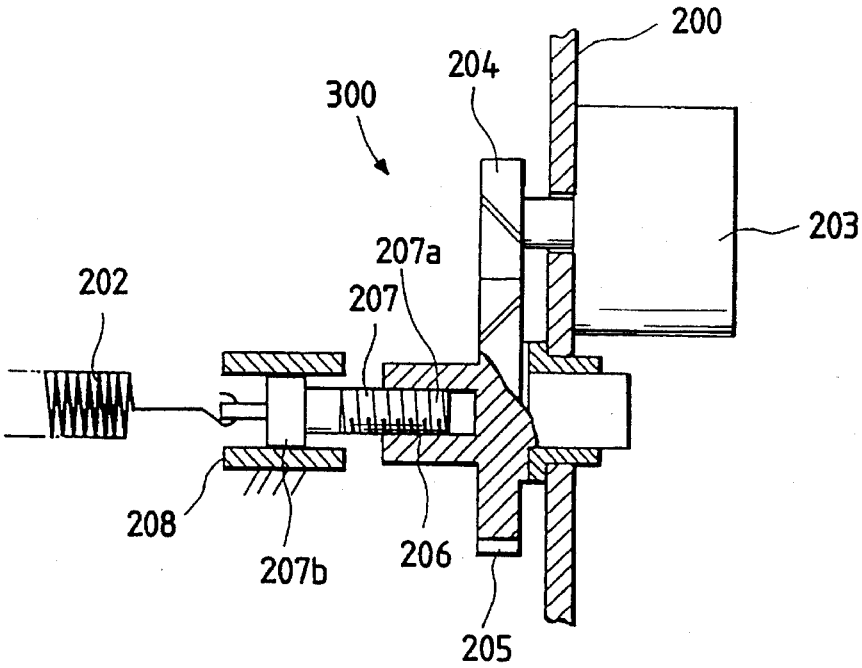
FIG. 6 is a sectional view showing pressing means of the invention.

An example in which the stencil printing drum structure of the embodiment described above with reference to FIGS. 1 through 5 is applied to the stencil printing apparatus described with reference to FIGS. 10 and 11 and further a changing means 300 for changing the elastic force of the springs 202 is provided in the stencil printing drum structure will be described with reference to FIG. 6.

A motor 203 acting as a driving means is fixed to the frame 200. A gear 204 provided on the motor driving shaft engages with a gear 205 rotatably attached to the frame 200. A female screw portion 206 is formed in the gear 205 so as to be parallel to the center of the axis. A male screw portion 207*a* formed at one end of a bolt 207 engages with the female screw portion 206. A guide portion 207*b* formed at the other end portion of the bolt 207 is guided by a guide portion 208 which is fixed to the frame 200 so as to be not rotatable. The guide portion 207*b* of the bolt 207 is connected to the frame 200 side end portion of the spring 202.

In the changing means 300 configured as described above, the bolt 207 moves in a predetermined direction along the guide portion 208 correspondingly to the direction of rotation of the gear 205 if the motor 203 is driven to rotate the gear 205. By the displacement of the bolt 207, the elastic force given to the spring 202 provided between the ink dam 7 and the bolt 207 is changed.

If the elastic force given to the spring 202 is changed, the contact state between the strap-like step portion 10 of the ink supply roller 3 and the ink dam 7 can be adjusted so that the rotation resistance of the ink supply roller 3 can be changed freely. Accordingly, the force of the ink supply roller 3, 23 pressing out the flexible peripheral wall portion 20 of the drum 1*a* can be adjusted correspondingly to the change of printing conditions such as kind of medium to be printed, kind of ink, printing environment temperature, etc.

Figure 7:
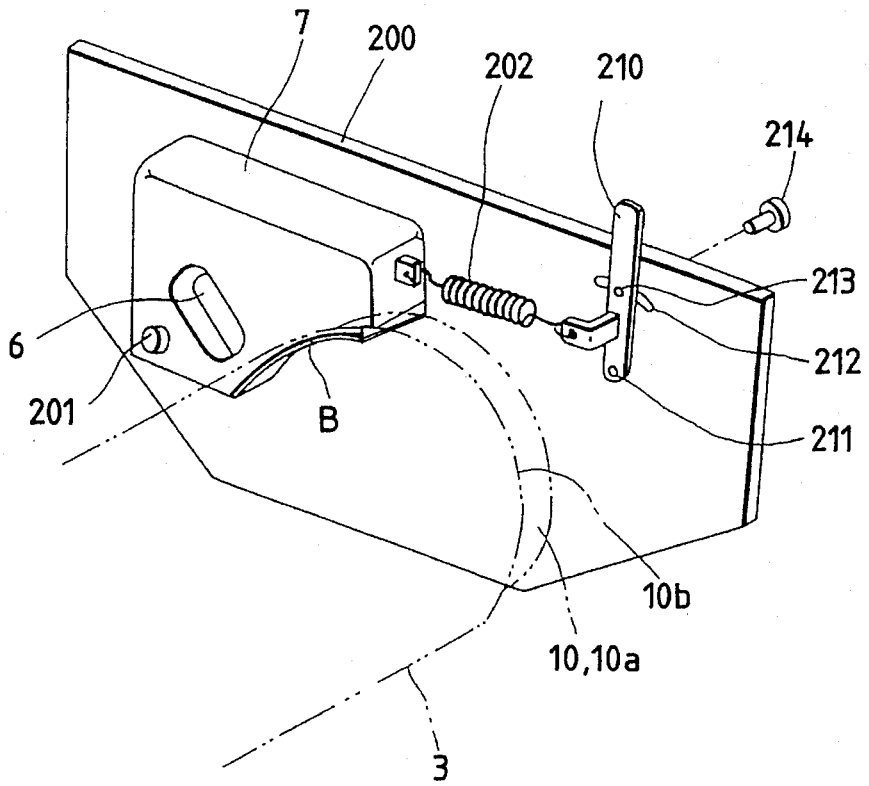
FIG. 7 is a perspective view showing another configuration of the pressing means according to the invention.

Referring to FIG. 7, another configuration embodiment of the changing means for changing the elastic force of the spring 202 will be described. One end portion of an adjustment arm 210 acting as the changing means for changing the elastic force of the spring 202 is attached to the frame 200 by a shaft 211 so as to be rotatable. The other end portion of the spring 202 having one end portion fixed to the ink dam 7 is fixed to an intermediate portion of the adjustment arm. A slit 212 shaped like a circular arc along the locus of the rotation of the adjustment arm 210 is formed in a part of the frame 200 which is in contact with the adjustment arm 210. A screw hole 213 is formed in a portion of the adjustment arm 210 corresponding to the slit 212. A fixing screw 214 is inserted into the fixing hole 213 of the adjustment arm 210 through the slit 212 from a side opposite to the frame 200, so that the adjustment arm 210 is fixed to the frame 200.

The adjustment arm 210 is rotated around the shaft 211 to thereby adjust the elastic force given to the spring 202. After the adjustment arm 210 is positioned at which the elastic force given to the spring 202 is set to a suitable value, the fixing screw 214 is inserted into the screw hole 213 through the slit 212 in that position. The adjustment arm 210 is fixed in the position and a desired amount of elastic force is applied to the ink dam 7, so that the contact state between the strap-like step portion 10 of the ink supply roller 3 and the ink dam 7 can be set to a desired state. Also in this embodiment, the same effect as in FIG. 6 can be obtained.

Figure 8:
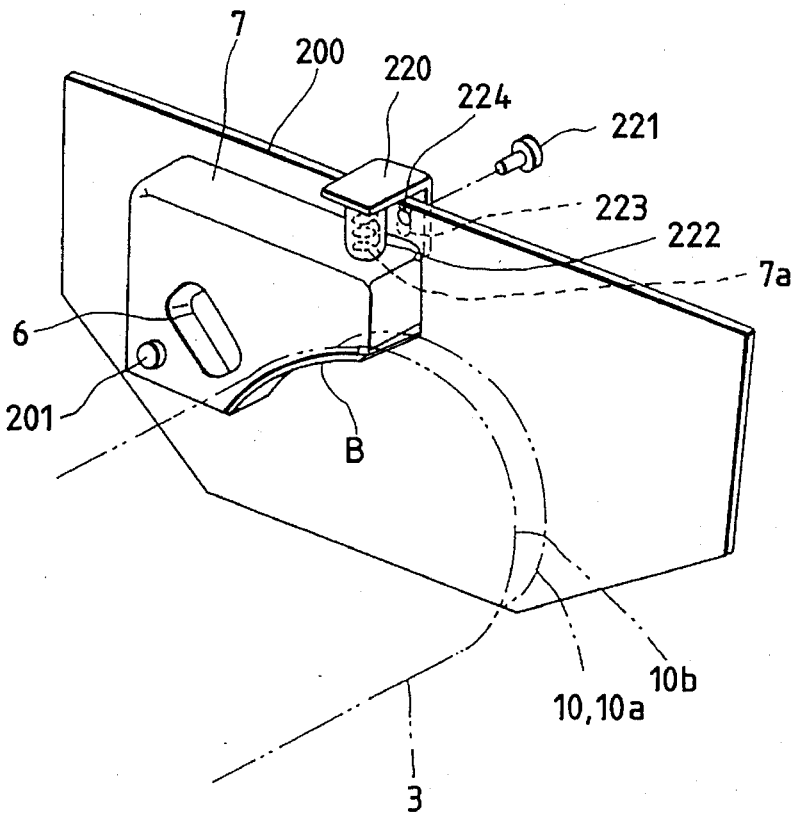
FIG. 8 is a perspective view showing still another a configuration of the pressing means of the invention.

Referring to FIG. 8, another embodiment of a pressing means having elastic force for pressing the ink dam 7 against the cylindrical surface 10*a* of the strap-like step portion 10, ad a changing means for changing the elastic force thereof will be described. A base portion of an L-shaped holder 220 is fixed to the frame 200 by a stop screw 221. A long hole 223 is provided in the frame 200, and a screw hole 224 is provided in the holder 220. Because the stop screw 221 is tightened into the screw hole 224 through the long hole 223 of the frame 200, the position of the holder 220 relative to the frame 200 can be adjusted.

A spring 222 acting as a pressing means is provided between a leading end portion of the holder 220 and the upper surface of the ink dam 7. The spring 222 is put on a projection 7*a* provided on the upper surface of the ink dam 7 and pressed down by the leading end portion of the holder 220.

If the position of the holder 220 relative to the ink dam 7 is adjusted suitably so that pressing force given to the ink dam 7 by the spring 222 is changed, the contact state between the strap-like step portion 10 of the ink supply roller 3 and the ink dam 7 can be set to a desired state. Also in this embodiment, the same effect as in FIG. 6 can be obtained.

Still another embodiment of the present invention will be described below with reference to FIGS. 12 through 16.

Figure 12:
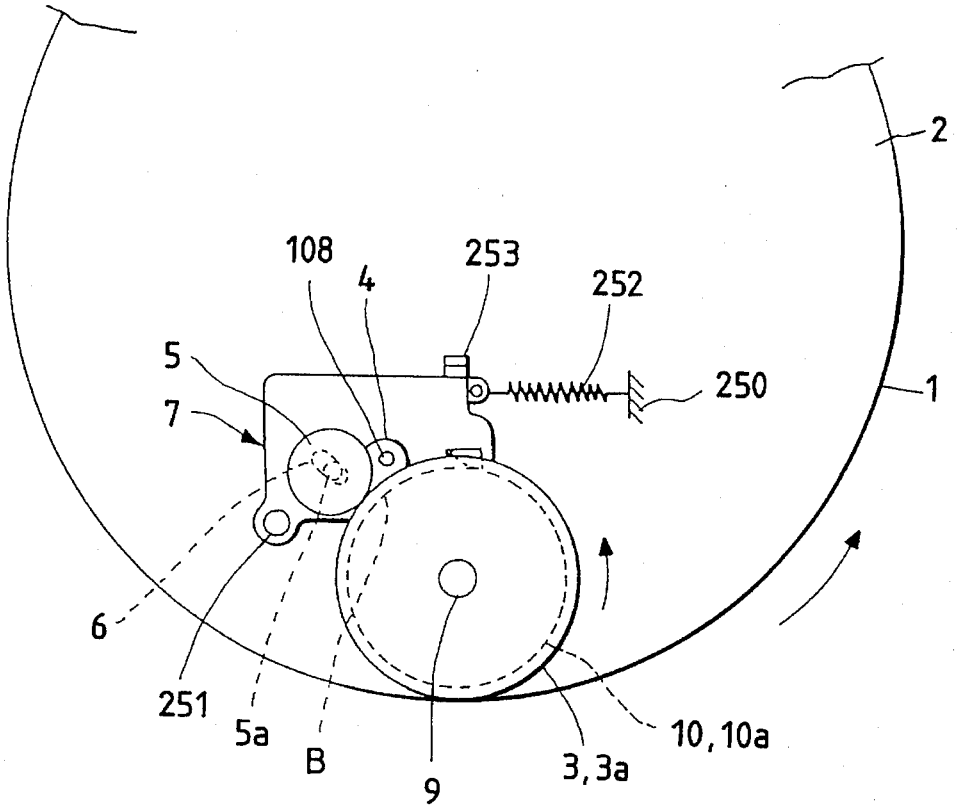
FIG. 12 is a view showing a schematic configuration of another stencil printing apparatus of the invention.
Figure 13:
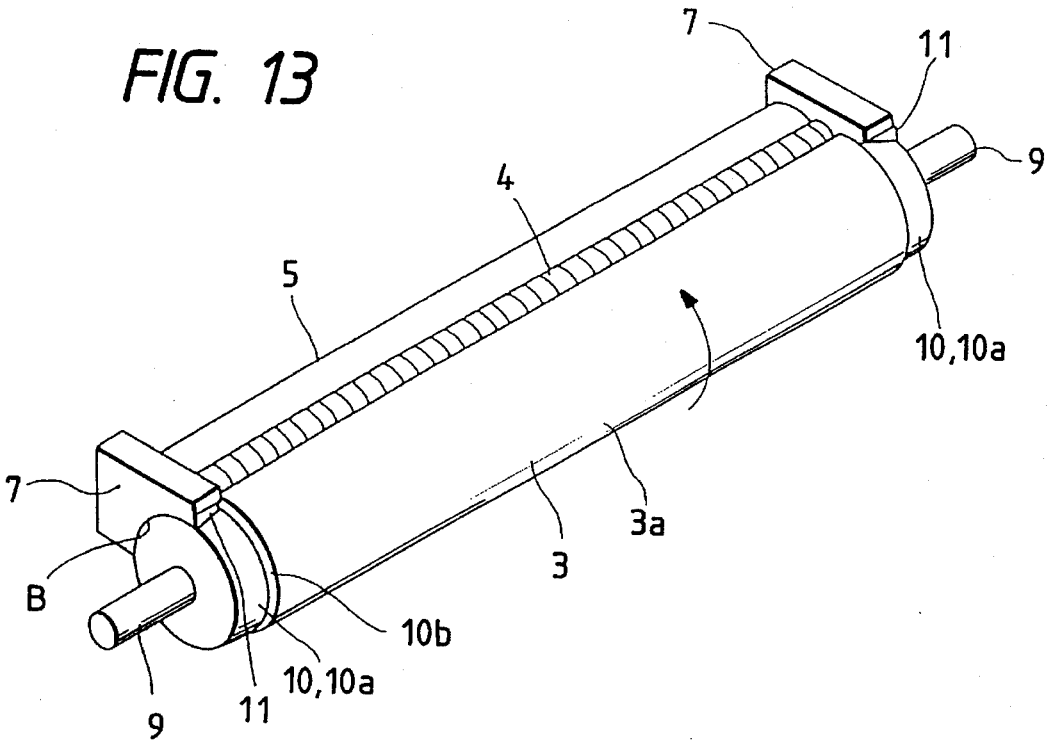
FIG. 13 is a perspective view showing the stencil printing apparatus of FIG. 12.

A stencil printing drum structure 1 shown in FIG. 12 has a drum 2 having an ink-permeable region. An ink supply roller 3 is provided in the inside of the drum 2. The circumferential surface of the ink supply roller 3 serves as an ink supply circumferential surface 3a for supplying ink to the inner circumferential surface of the drum 2. The ink supply roller 3 is arranged so as to be rotatable around a rotary shaft 9 parallel to the center axis of the drum 2 and so that the ink supply circumferential surface 3a can touch the inner circumferential surface of the drum 2. The printing drum structure 1 is designed so as to rotate counterclockwise in FIG. 12. The drum 2 is constituted by a porous plate or screen having a large number of fine pores formed therein. Though not shown, a sheet of stencil paper is wound on the surface of the drum 2 and an end of the paper is locked by a locking device.

An ink application roller 5 is provided in the inside of the drum 2. The ink application roller 5 is disposed so as to be parallel to the ink supply roller 3 and is formed so that ink in an ink reservoir portion 4 is applied onto the ink supply roller 3.

Though not shown, an ink distributer is provided above the ink supply roller 3 so that ink supplied by an ink supply means not shown is supplied between the ink supply roller 3 and the ink application roller 5 to thereby form the ink reservoir portion 4 between the two rollers 3 and 5.

A driving rod 108 arranged in the ink reservoir portion 4 rotates in a direction reserve to the direction of rotation of the ink supply roller 3 so that the diameter of a whirlpool created in ink in the ink reservoir portion 4 is made uniform.

Strap-like step portions 10 each of which has a cylindrical surface 10*a* having a width A and an external diameter smaller than the external diameter of the ink supply roller 3 are formed at the axially opposite ends of the ink supply roller 3 along the whole circumference of the roller 3. Further, a pair of ink dams 7 are provided at the axially opposite ends of the ink supply roller 3 so that the ink reservoir portion 4 is formed between the pair of ink dams 7.

Each of the ink dams 7 is a substantially rectangular-parallelopiped member having a concavely curved slide surface B on its one corner so that the slide surface B is in contact with the cylindrical surface 10*a* of each of the strap-like step portions 10 so as to hang over the cylindrical surface 10*a*. Further, a part of the inner side surface C of each of the ink dams 7 is disposed so as to contact with a wall portion 10*b* of the strap-like step portion 10.

Figure 14:
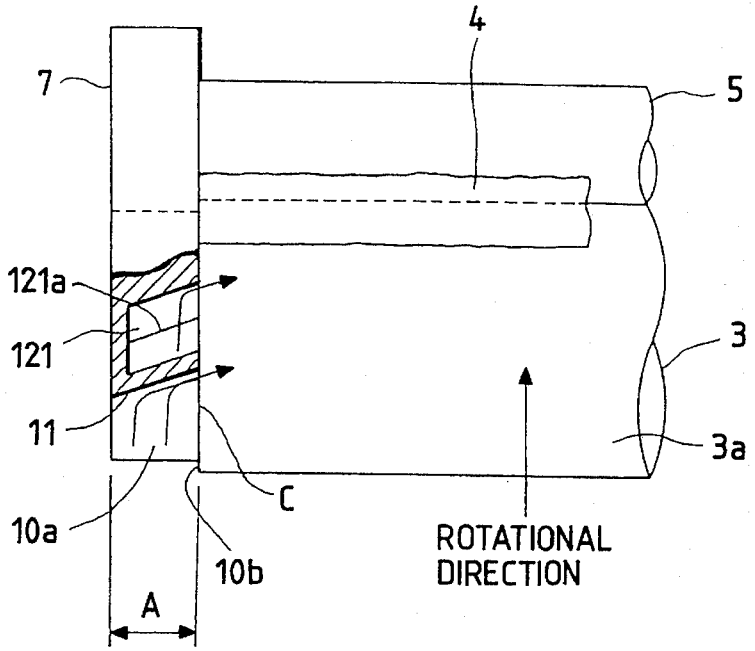
FIG. 14 is a plan view showing the strap-like step portion in FIG. 13.

A first inclined surface 11 is provided in an upper end portion of the slide surface B of each of the ink dams 7 so that ink leaked onto the strap-like step portion 10 is led into the ink reservoir portion. As shown in FIG. 14, the first inclined surface 11 is formed at an angle of inclination such that the depth of a portion near the inside of the ink supply roller 3 is larger than the depth of a portion near the outer end portion of the ink supply roller 3 with respect to the direction of rotation of the ink supply roller 3 as represented by the linear arrow shown in FIG. 14. Further, the angle between the first inclined surface 11 and the cylindrical surface 10*a* is set to a nearly right angle. Further, the height of the first inclined surface 11 with respect to the cylindrical surface 10*a* is more than the height of the wall portion 10*b* of the strap-like step portion 10, so that the first inclined surface 11 extends upward of the ink supply circumferential surface 3*a* of the ink supply roller 3.

Accordingly, ink leaked onto the cylindrical surface 10*a* of the strap-like step portion 10 is received by the first inclined surface 11 of the ink dam 7 as the ink supply roller 3 rotates and led by the first inclined surface 11 so as to go back to the inner side of the ink supply roller 3.

In this embodiment, however, ink on the cylindrical surface 10*a* cannot be scraped sufficiently and a slight amount of ink remains, because the angle between the first inclined surface 11 and the cylindrical surface 10*a* of the strap-like step portion 10 is a nearly right angle. If the angle of the leading end edge portion of the first inclined surface 11 is sharpened to solve this problem, the leading end edge portion will dig into the cylindrical surface 10*a* so that the rotation of the ink supply roller 3 may be prohibited or the cylindrical surface 10*a* may be cut and damaged. Further, the wall portion 10*b* and the ink dam 7 in the boundary between the ink supply circumferential surface 3*a* and the cylindrical surface 10*a* are not always entirely in close contact with each other because of the variety of accuracy in machining the wall portion 10*b* and the ink dam 7. Accordingly, a gap may be sometimes generated between the wall portion 10*b* and the ink dam 7 when the ink supply roller 3 rotates. Therefore, part of ink scraped by the first inclined surface 11 may enter the gap and may be left so as to be deposited on the wall portion 10*b*.

In this embodiment, therefore, a second inclined surface 121 is formed on the slide surface B of each the ink dam 7 in order to recover ink deposited on the cylindrical surface 10*a* which is not recovered by the first inclined surface 11. The second inclined surface 121 is adjacent to the first inclined surface along the direction of rotation of the ink supply roller and has a function of slidably touching the cylindrical surface 10*a*, scraping ink deposited on the strap-like step portion 10 in accordance with the rotation of the ink supply roller 3 and leading the scraped ink to the ink supply circumferential surface 3*a*.

Figure 16:
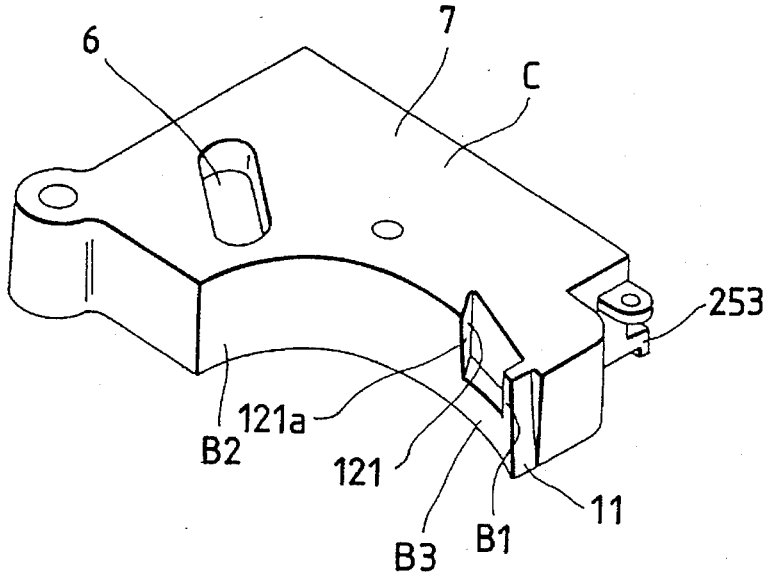
FIG. 16 is a perspective view showing another ink dam in the invention.

As shown in FIGS. 14 and 16, the angle between the second inclined surface 121 and the cylindrical surface 10*a* is larger than the angle between the first inclined surface and the cylindrical surface 10*a*, that is, the leading end edge portion 121*a* is sharpened. Accordingly, the second inclined surface 121 is superior, in the function of scraping ink on the cylindrical surface 10*a*, to the first inclined surface 11.

As shown in FIG. 16, a slide surface B is near the leading end edge portion 121*a* of the second inclined surface 121. That is, a slide surface B1 is disposed adjacently to and in the rear of the leading end edge portion 121*a* with respect to the direction of rotation of the ink supply roller 3, a slide surface B2 is disposed adjacently to and in front of the leading end edge portion 121*a* with respect to the same rotation direction, and a slide surface B3 is disposed between the first and second inclined surfaces 11 and 121. In this manner, the slide surface B surrounding the leading end edge portion 121*a* is supported onto the cylindrical surface 10*a*. Accordingly, even in the case where the angle of the leading end edge portion 121*a* is sharp, the leading end edge portion 121*a* is prevented from digging into the cylindrical surface to thereby damage the ink supply roller or prohibit the rotation of the ink supply roller.

The upper edge of the second inclined surface 121 is located above the ink supply circumferential surface 3*a* of the ink supply roller 3, so that ink can be led to the ink supply circumferential surface 3*a*.

According to the second inclined surface 121 configured as described above, ink not scraped by the first inclined surface can be scraped securely thereby. Because the second inclined surface 121 is inclined at a large angle with respect to the direction of rotation of the ink supply roller 3 (that is, the second inclined surface 121 touches the cylindrical surface 10*a* by the sharp-angle leading end edge portion 121*a*), the scraped ink slowly moves inward of the ink supply roller 3 while climbing the second inclined surface 121 as represented by the arrow in FIG. 14 so that the ink is returned, in due time, onto the ink supply circumferential surface 3*a* which is in front of the ink reservoir portion 4 with respect to the direction of rotation of the ink supply roller 3. Then, the ink is once absorbed to the ink reservoir portion 4 and the ink is recycled for printing.

Figure 15:
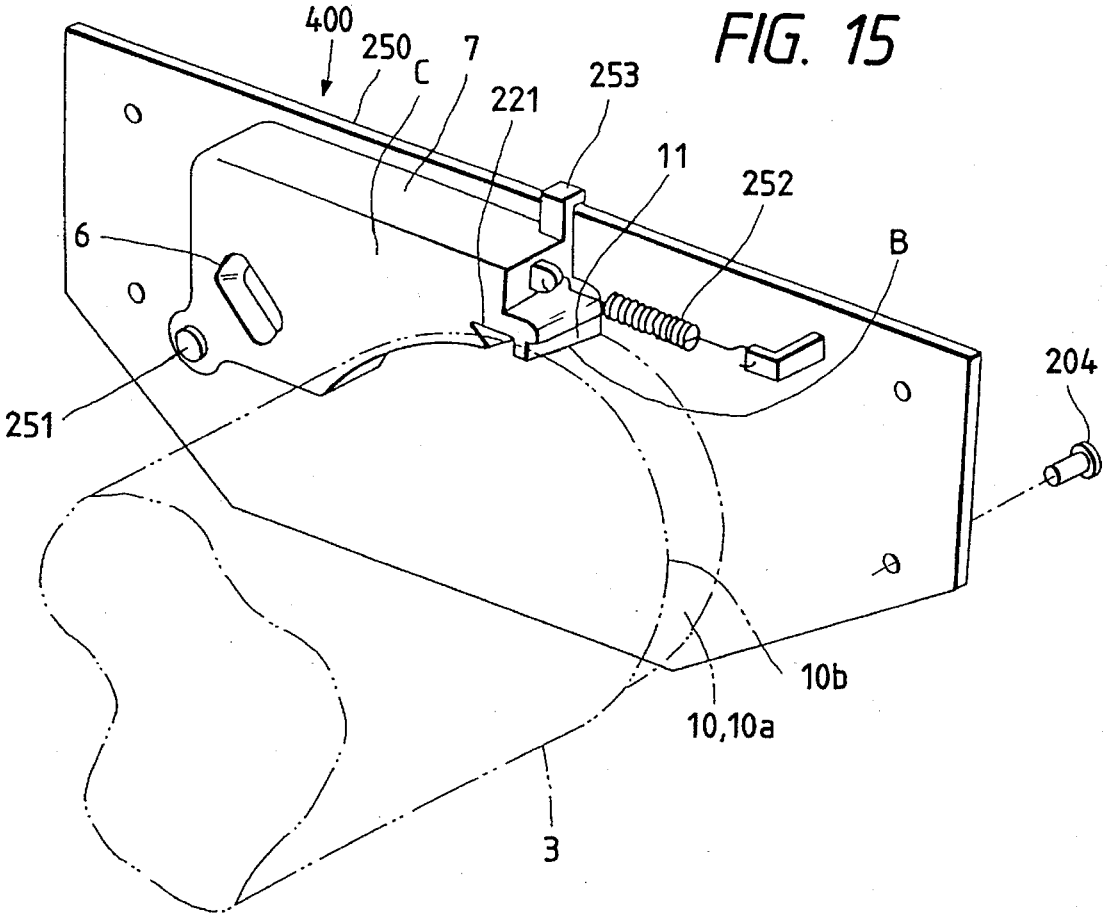
FIG. 15 is a perspective view showing an ink dam unit including an ink dam connected with a side plate, and an ink supply roller.

As shown in FIG. 15, one end portion of the ink dam 7 is attached to a side plate 260 of this apparatus so as to be rotatable around a shaft 251. The other end portion of the ink dam 7 is connected to the side plate 250 through a spring 252 acting as a pressing means. The ink dam 7 pulled by the spring 252 rotates around the shaft 251 so as to come near the ink supply roller 3, and the slide surface B thereof is brought into contact with the cylindrical surface 10*a* of the strap-like step portion 10 of the ink supply roller 3 by a predetermined amount of pressure. The slide surface B is constituted by a member, such as a brake shoe, separate from the body of the ink dam 7, taking into account abrasion resistance and frictional resistance. That is, the slide surface B is removable so that it can be exchanged when worn out.

A stopper 253 is stopped in the upper edge of the side plate 250 by the force of the spring 252 to prevent the ink dam 7 from moving unnecessarily when the ink dam 7 is used in the form of a unit formed by attaching the ink dam 7 to the side plate 250. In a state in which an ink dam unit 400 united by attaching the ink dam 7 to the side plate 250 as shown in FIG. 15 is assembled into the stencil printing apparatus by stop screws 204, or the like, the stopper 253 is slightly floated up from the upper edge of the side plate 250. When the ink dam unit 400 is tried to be attached into the stencil printing apparatus, the ink dam unit 400 is easy to handle so that the ink dam unit 400 can be assembled into the apparatus (particularly the ink supply roller 3) easily because the stopper 253 is stopped on the side plate 250 so as not to be rotated any more than expected by the force of the spring 252.

A long groove 6 is formed in the inside of each the ink dam 7 so that support shafts 5*a* in opposite end portions of the ink application roller 5 are movably supported to thereby make it possible to adjust the gap between the ink supply roller 3 and the ink application roller 5. The distance between the ink application roller 5 and the ink supply roller 3 can be set to a desired state by moving/adjusting the mount position of the ink application roller 5 with respect to the ink dam 7 along the groove 6.

In FIG. 12, when the stencil printing drum structure 1 rotates counterclockwise, the ink supply roller 3 rotates counterclockwise around the rotary shaft 9. Ink supplied by an ordinary supply means not shown is supplied through the ink distributer to the neighborhood of the contact portion between the ink application roller 5 and the ink supply roller 3 to form an ink reservoir portion 4. A bar-like ink whirlpool is formed in the ink reservoir portion 4 as the printing operation is carried out, so that ink is applied onto the ink supply roller 3 by the ink application roller 5. The ink applied onto the ink supply roller 3 is supplied to the inner circumferential surface of the drum 2.

The ink which forms the ink reservoir portion 4 is prevented from spreading laterally out of the side wall of each the ink dam 7. The slide surface B of the ink dam 7 is in contact with the cylindrical surface 10*a* of the strap-like step portion 10, and ink leaked onto the strap-like step portion 10 of the ink supply roller 3 is returned to the ink reservoir portion 4 by the first inclined surface 11 of the ink dam 7 which is in contact with the wall portion 10*b* of the strap-like step portion 10.

Even in the case where ink leaked onto the strap-like step portion 10 is imperfectly scraped by the first inclined surface 11, the remaining ink not scraped can be scraped securely by the second inclined surface 121. The second inclined surface 121 scrapes ink from the cylindrical surface 10*a* securely by the sharp-angle leading end edge portion 121*a*. The thus scraped ink moves inward of the ink supply roller 3 while guided by the second inclined surface 121, so that the ink is returned onto the ink supply circumferential surface 3*a* which is in front of the ink reservoir portion 4.

In this manner, the stencil printing drum structure 1 in this apparatus has ink dams 7 each having two inclined surfaces 11 and 121 for recovering ink leaked onto opposite ends of the ink supply roller 3. Accordingly, ink is limited securely so as not to be leaked out of the ink supply range of the ink supply roller 3. Accordingly, there arises no problem that the printing apparatus and sheets of printing paper are stained with ink.

Further, the ink dam 7 is urged against the strap-like step portion 10 of the ink supply roller 3 by elastic force of the spring 252 while kept rotatable around the shaft 251 so as to move far from the ink supply roller 3 when the ink dam 7 receives some load from the ink supply roller 3 rotating in a period of printing. Accordingly, not only the contact state between the ink dam 7 and the ink supply roller 3 is kept stable but also the contact state between the ink dam 7 and the strap-like step portion 10 of the ink supply roller 3 is set/kept good regardless of error in machining the ink dam 7 and error in mounting the ink dam 7 to the ink supply roller 3.

Figure 17:
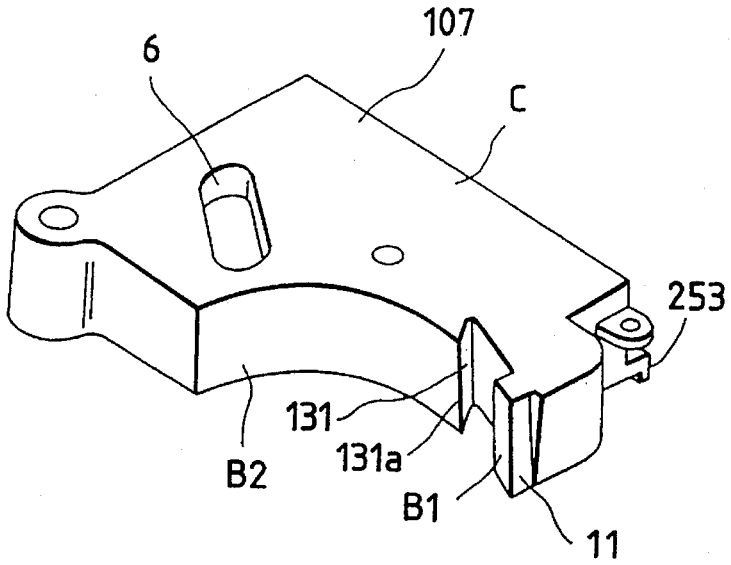
FIG. 17 is a perspective view showing still another ink dam in the invention.

FIG. 17 is a perspective view showing another embodiment of the shape of the ink dam. In this ink dam 107, a groove portion formed between the first inclined surface 11 and the second inclined surface 131 pierces the ink dam 107 between opposite side surfaces of the ink dam 107. Accordingly, the leading end edge portion 131*a* of the second inclined surface 131 is surrounded by the slide surfaces B1 and B2 in two, front and rear directions. The area of the slide surface B1 continued to the first inclined surface in FIG. 17 is set to be larger than the area of the slide surface B1 continued to the first inclined surface 11 in FIG. 16. As a result, the leading end edge portion 131*a* of the second inclined surface 131 is prevented from digging into the cylindrical surface 10*a* of the ink supply roller 3.

In the stencil printing drum structure of the above embodiment, the strap-like step portions 10 each of which has an external diameter smaller than the external diameter of the ink supply roller 3 are provided at the opposite ends of the ink supply roller 3 and the rotatably pivoted ink dams 7 are brought, by elastic force of springs 202, into contact with the strap-like step portions 10 so that the ink leaking onto the strap-like step portions 10 is returned to the inner side of the ink supply roller 3 by means of the first and second inclined surfaces 11 and 121 provided in the ink dams 7. Accordingly, in this embodiment, there arises no problem that the printing apparatus and the printing sheet are stained with ink, because the contact state between the strap-like step portion 10 of the ink supply roller 3 and the ink dam 7 is stable so that ink does not leak out of the ink supply range of the ink supply roller 3.

In the stencil printing drum structure according to the present invention, strap-like step portions each having a smaller external diameter than the external diameter of an ink supply roller are provided at opposite ends of the ink supply roller so that not only ink dams are brought into contact with the step portions respectively but also ink leaked onto the strap-like step portions is returned to the inner side of the ink supply roller by a inclined surfaces provided in the ink dams. Accordingly, in the present invention, because ink is not leaked out of the ink supply range of the ink supply roller, there arises no problem that the printing apparatus and the printing sheet are stained with ink.

Further, in the stencil printing drum structure of the present invention having a pressing means provided with elastic force for pressing the ink dams against the cylindrical surfaces of the strap-like step portions, and a changing means for changing the elastic force of the pressing means, a desired amount of printing pressure can be obtained by setting the rotation resistance of the ink supply roller suitably. Accordingly, optimum printing can be performed correspondingly to the change of printing conditions such as kind of paper, kind of ink, printing environment temperature, etc. to thereby obtain a sharp printing image.

In the stencil printing drum structure according to the present invention, strap-like step portions each having a smaller external diameter than the external diameter of an ink supply roller are provided at opposite ends of the ink supply roller so that not only ink dams are brought into contact with the step portions respectively but also ink leaked onto the strap-like step portions is returned to the inner side of the ink supply roller securely by first and second inclined surfaces provided in the ink dams. Accordingly, in the present invention, because ink is not leaked out of the ink supply range of the ink supply roller, there arises no problem that he printing apparatus and sheets of printing paper are stained with ink.

Further, in the stencil printing drum structure of the present invention having a pressing means provided with elastic force for pressing the ink dams against the cylindrical surfaces of the strap-like step portions, the abrasion of the slide surfaces of the ink dams has no influence on the ink scraping effect of the ink dams even in the case where the slide surfaces of the ink dams are worn out. Accordingly, there arises an effect excellent in durability and reliability.

We claim:

1. A stencil printing drum structure comprising:

a drum including a cylindrical wall portion having an ink-permeable region;

an ink supply roller provided in parallel to said drum, said ink supply roller being rotating around an axis parallel to the center axis of said drum and in contact with the inner circumferential surface of said drum;

an ink application roller provided in parallel to said ink supply roller to form an ink reservoir portion between said ink application roller and said ink supply roller, for applying ink onto a surface of said ink supply roller in accordance with rotating said ink supply roller;

a pair of strap-like step portions including cylindrical surfaces extending from opposite ends of said ink supply roller respectively along the whole circumference of said ink supply roller, each of said cylindrical surface having an external diameter smaller than the external diameter of said ink supply roller;

a pair of ink dams each of which has a first inclined surface slidably touching said cylindrical surface of corresponding one of said strap-like step portions for leading ink leaking onto the strap-like step portion into said ink reservoir portion; and pressing means having elastic force for urging said ink dams against said cylindrical surfaces of said strap-like step portions respectively.

2. The stencil printing drum structure according to claim 1, further comprising changing means for varying the elastic force of said pressing means.

3. The stencil printing drum structure according to claim 2, wherein:

said cylindrical wall portion of said drum is flexible;

said drum structure further comprises a driving mechanism for rotating said ink supply roller in synchronism with the rotation of said drum; and said driving mechanism includes, a first gear rotating around an axis parallel to the center axis of said drum in synchronism with said drum, a first arm member swingable around an axis coincident with the axis of said first gear, said first arm member including a free end, a second gear rotatably supported on said free end of said first arm member to rotate in accordance with said first gear, a second arm member swingable around an axis parallel to the axis of said first arm member, said second arm member having a free end, and a third gear rotatably supported on said free end of said second arm member and meshed with said second gear, said third gear being rotated along with said ink supply roller in accordance with said second gear.

4. The stencil printing drum structure according to claim 1, wherein each of said ink dams includes a second inclined surface adjacent to said first inclined surface with respect to the direction of rotation of said ink supply roller and slidably touching said cylindrical surface of said strap-like step portion for scrapping ink deposited on said strap-like step portion by the rotation of said ink supply roller and leading the ink thus scrapped onto said ink supply roller.

5. The stencil printing drum structure according to claim 4, wherein an angle between said second inclined surface and said cylindrical surface of said strap-like step portion is set to be larger than an angle between said first inclined surface and said cylindrical surface of said strap-like step portion.

6. The stencil printing drum structure according to claim 1, wherein each of said ink dams includes a stopper for preventing said ink dams from pivotally moving.

7. A stencil printing drum structure comprising:

a drum including a cylindrical wall portion having an ink-permeable region;

an ink supply roller provided in parallel to said drum, said ink supply roller being rotating around an axis parallel to the center axis of said drum and in contact with the inner circumferential surface of said drum;

an ink application roller provided in parallel to said ink supply roller to form an ink reservoir portion between said ink application roller and said ink supply roller, for applying ink onto a surface of said ink supply roller in accordance with rotating said ink supply roller;

a pair of strap-like step portions including cylindrical surfaces extending from opposite ends of said ink supply roller respectively along the whole circumference of said ink supply roller, each of said cylindrical surface having an external diameter smaller than the external diameter of said ink supply roller;

a pair of ink dams each of which includes, a first inclined surface slidably touching said cylindrical surface of corresponding one of said strap-like step portions, for leading ink leaking onto the strap-like step portion into said ink reservoir portion, and a second inclined surface adjacent to said first inclined surface with respect to the direction of rotation of said ink supply roller and slidably touching said cylindrical surface of said strap-like step portion, for scrapping ink deposited on said strap-like step portion by the rotation of said ink supply roller and leading the ink thus scrapped onto said ink supply roller.

8. The stencil printing drum structure according to claim 7, wherein an angle between said second inclined surface and said cylindrical surface of said strap-like step portion is set to be larger than an angle between said first inclined surface and said cylindrical surface of said strap-like step portion.

9. The stencil printing drum structure according to claim 7, wherein each of said ink dams includes a stopper for preventing said ink dams from pivotally moving.

* * * * *